United States Patent [19]

Uth et al.

[11] 3,991,797

[45] Nov. 16, 1976

[54] RINSING DEVICE FOR CIRCULATING ONE-CHAMBER VESSEL FILLING MACHINES

[75] Inventors: Gerhard Uth, Bad Kreuznach; Heinrich Zeimet, Bingen-Budesheim; Alfred Rentel, Ban Kreuznach-Winzenheim, all of Germany

[73] Assignee: Seitz-Werke G.m.b.H., Bad Kreuznach, Germany

[22] Filed: Nov. 29, 1974

[21] Appl. No.: 528,505

Related U.S. Application Data

[63] Continuation-in-part of Ser. No. 391,472, Aug. 24, 1973, abandoned, which is a continuation of Ser. No. 186,105, Oct. 4, 1971, abandoned.

[30] Foreign Application Priority Data

Oct. 3, 1970 Germany ..... 2048741

[52] U.S. Cl. ..... 141/91; 134/166 C

[51] Int. Cl.[2] ..... B08B 9/00; B65B 3/04

[58] Field of Search ..... 141/1, 39–44, 141/85, 89–92; 222/148; 134/22 R, 166 R, 166 C, 171

[56] References Cited

UNITED STATES PATENTS 3,513,024 5/1970 Culliton ..... 141/91 X

*Primary Examiner*—Richard E. Aegerter
*Assistant Examiner*—Frederick R. Schmidt
*Attorney, Agent, or Firm*—Walter Becker

[57] ABSTRACT

A device for cleaning a rotating vessel filling machine, especially bottle filling machines, of the one-chamber type with a feeding pipe for feeding a liquid or gaseous cleaning medium into filling containers and filling elements. Each of the filling elements includes a housing closure with an outlet that leads to an exhaust and that is closed and opened by a control valve. The filling elements are connected to annular passage means through vessel pressure relieving means. The annular passage means are connected through conduit means both to be brought into communication with a cleaning substance feeding conduit and also to be disconnected therefrom.

6 Claims, 11 Drawing Figures

INVENTORS:
Gerhard Alth
Heinrich Zeimet
Alfred Rentel
By Walter Becker

INVENTORS:
Gerhard Uth
Heinrich Zeimet
Alfred Rentel
By Walter Berger

RINSING DEVICE FOR CIRCULATING ONE-CHAMBER VESSEL FILLING MACHINES

This is a continuation-in-part of co-pending application Ser. No. 391,472—Uth et al filed Aug. 24, 1973, which was a continuation of parent case Ser. No. 186,105—Uth et al filed Oct. 4, 1971 (Monday), both now being abandoned.

The present invention relates to a rinsing device for vessel filling machines of the one-chamber construction type with a conduit connected to the filling container for introducing a fluid rinsing medium that can be liquid as well as gaseous into the filling container and filling elements. Access thereto is by means of a detachable upper housing cover and by means of conduits that can be closed and leading to the gas and liquid side of the container. The filling elements are intended for passage of tensioning and return gas and liquid. The filling elements are laterally connected to the container mantle and are provided with a valve controlled vessel relief.

Ordinarily, vessel filling machines prior to being taken into operation require an intensive cleaning of the filling tank and of the filling elements by a rinsing liquid such as steam in order to remove deposits which collected in the gas and liquid paths and affect the quality and durability of the material to be filled in. To this end, with filling machines of the above mentioned type, the filling tank is filled with a rinsing medium which is supplied through the connected pipe line and which, in most instances, is a liquid rinsing medium. This rinsing medium will, when the container is flooded through the gas and liquid connections on the container side, flow into the filling elements. For purposes of rinsing the filling elements with further supplied rinsing medium, the valves of the tensioning and return gas conduits as well as the liquid conduits are opened and the upper housing cover means are removed so that the rinsing medium will be able through the freed gas and liquid path to flow downwardly and also through the open housing openings will be able to flow upwardly out of the elements. For purposes of cleaning the vessel relief conduits, which cleaning operation is effected separately, vessels are respectively pressed against the filling elements and are filled with rinsing means through the liquid inlet, said rinsing means subsequently flowing into the open through corresponding opened paths.

Such an operation is, however, disadvantageous and time-consuming. Especially it is considered awkward and disadvantageous that for each cleaning operation the housing covers of the elements have to be removed and have again to be assembled while they have to be cleaned separately and have to be handled very carefully when reassembling the same in order not to destroy the result of the cleaning operations by new reinfection of the elements. Also highly disadvantageous with regard to the previously practiced method is the fact that considerable time is required for cleaning the vessel relief conduits, especially the pressing on of the vessels without which a return flow of the rinsing medium into the previously opened relief path is not possible. Another great disadvantage of the heretofore known method is seen in the fact that the cleaning of the relief conduits can be effected only separately and only after the elements have been rinsed and that after the cleaning of the relief conduits, it is still necessary once more briefly to rinse the liquid outlet.

It is, therefore, an object of the present invention to provide a rinsing device for the above mentioned one-chamber-vessel filling machines, which rinsing device will avoid the above mentioned drawbacks encountered with heretofore known devices of the type involved when cleaning the filling container and filling elements.

This object and other objects and advantages of the invention will appear more clearly from the following specification in connection with the accompanying drawings, in which.

The rinsing device according to the present invention is cahracterized primarily in that the filling elements respectively comprise a housing cover with a housing outlet which leads from the interior of the housing into the open and is provided with a shut-off element that can be closed or opened, said filling elements being, by the vessel relief conduit, connected to a common annular passage which communicates through a conduit adapted to be closed off with the conduit for the rinsing medium leading to the filling container. In this way, a thorough automatic cleaning of the filling tank and of the filling elements is obtained by a simple manual or mechanical control of the shut-off valve which closes the housing outlet during the filling operation. The pressing on of the respective vessel for purposes of cleaning the relief conduits, and the individual cleaning operations may nearly simultaneously or in direct succession be effected.

According to a preferred embodiment of the invention, the housing outlet is formed by a passage which extends within the housing cover horizontally to the interior of the housing while the associated shut-off valve comprises a valve with spring-free piston slide which extends concentrically through the housing cover. The piston slide is displaceable vertically in front of the passage mouth on the housing side and for purposes of manual actuation or by means of the machine has an upper extension protrude from the housing cover.

According to a further development of the invention, the housing cover is, within the range of the passage mouth on the housing side, provided with a hollow chamber into which the housing passage as well as radial bores that can be shut off lead from the piston slide into an end position of its path of movement. To this end, according to a further suggestion of the invention, the piston slide is expediently provided with a constricted central portion surrounded by the hollow chamber. This central portion is provided, when the radial bores are freed, to establish the connection to the hollow chamber. Furthermore, according to the invention, it is suggested to provide the piston slide with a lower extension which, when the passage is open, acts directly upon the tensioning and return gas valve and indirectly upon the liquid valve and which is provided to block the valves in their closing position. It is furthermore suggested for purposes of mechanically opening the shut-off element on the filling machine, which mechanical opening is preferred according to the invention, to provide a control cam which is able to be tilted into the path of circulation of the elements.

Figure 1:
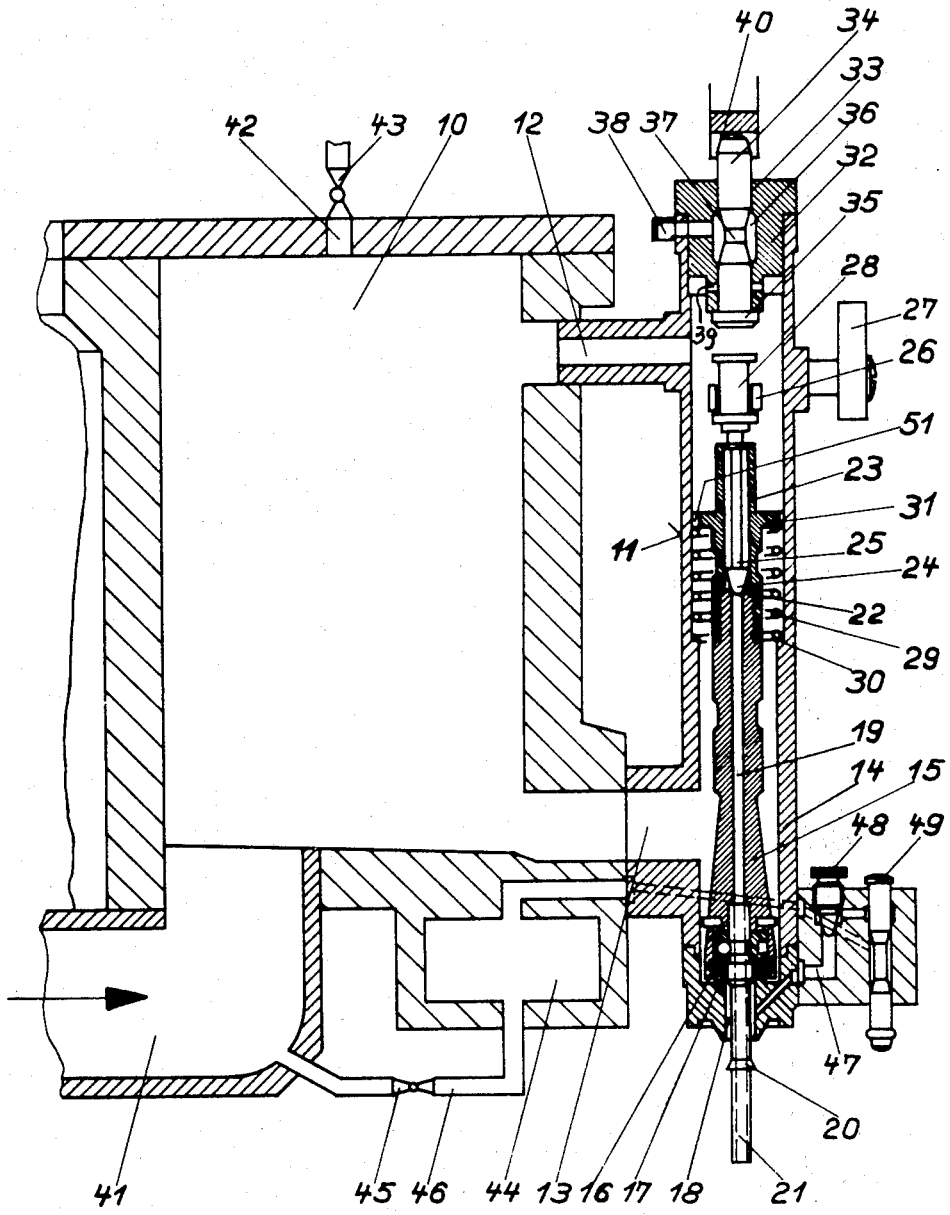
FIG. 1 shows a one-chamber counter pressure filling machine from the front.
Figure 2:
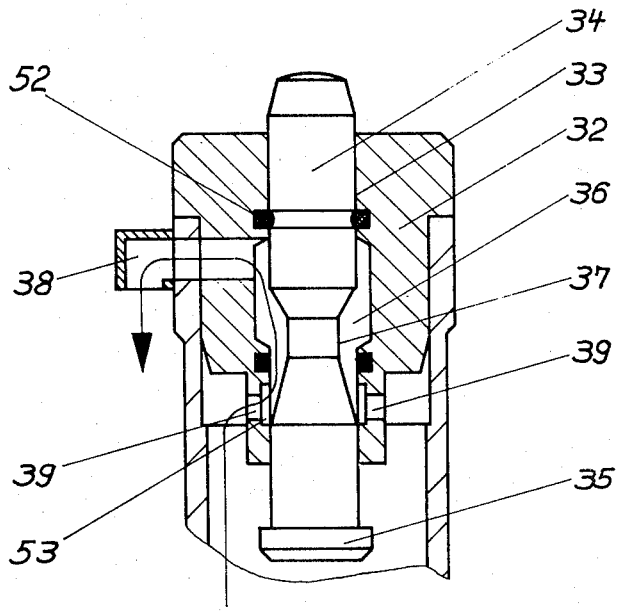
FIG. 2 shows a plan view of the filling machine.

The filling machine according to FIGS. 1 and 2 operates according to an isobarometric system and serves for filling off carbonated beverages into bottles. For this purpose, the bottles are preloaded with a tensioning gas located with a filling material container of the machine and such preloading is to the pressure of the filling material. During introduction of the filling material into the bottles occurring on the basis of the high drop, there is noted that the tensioning gas subsequently becomes displaced and flows back into the filling material container as return gas. The filling machine has a lower part 1 supported upon a surface and an upper part 2 connected therewith. In the machine lower part 1 there are accommodated drive devices and driven devices which are not shown. These devices bring about the rotation of the lift elements 3 belonging to the upper part 2 as well as the lower part 1 for receiving the bottles running into the machine. With the drive devices and driven devices there are further connected the bottle sprockets 4 and 5 belonging to the machine lower part and these at a time are provided on the input and output sides of the machine as well as being provided with a dividing worm 7 secured in front of the bottle input sprocket 4 in the range or area of the bottle conveyor path 6 for the bottles guided to the machine. There is provided a tubular conduit 8 leading to a machine lower part 1. This conduit 8 passes through the middle axis 9 of the machine as recognizable in FIG. 3 and emanates into a branch 41 in the container 10 of the machine as undertaken to have a mouth as the branch 41 in the area of the machine upper part 2.

On the filler container 10, which is embodied in an annular shape or ring form and serving for receiving the filling material and the tensioning-gas and return gas located above the filling material, there are filling elements 11 fastened on the outer periphery. The number thereof corresponds to the number of lifting elements 3 relative to which the same are located across therefrom in a common plane determined by the bottle size. In a purposeful manner as shown in FIG. 1, there is noted that every filling element 11 is flanged laterally on the outer container mantle 59 and connected with a gas feeding path 12 and a separate liquid feeding path 13 as to corresponding outlets of the container 10 in a manner sealed against gas and fluid.

Figure 4:
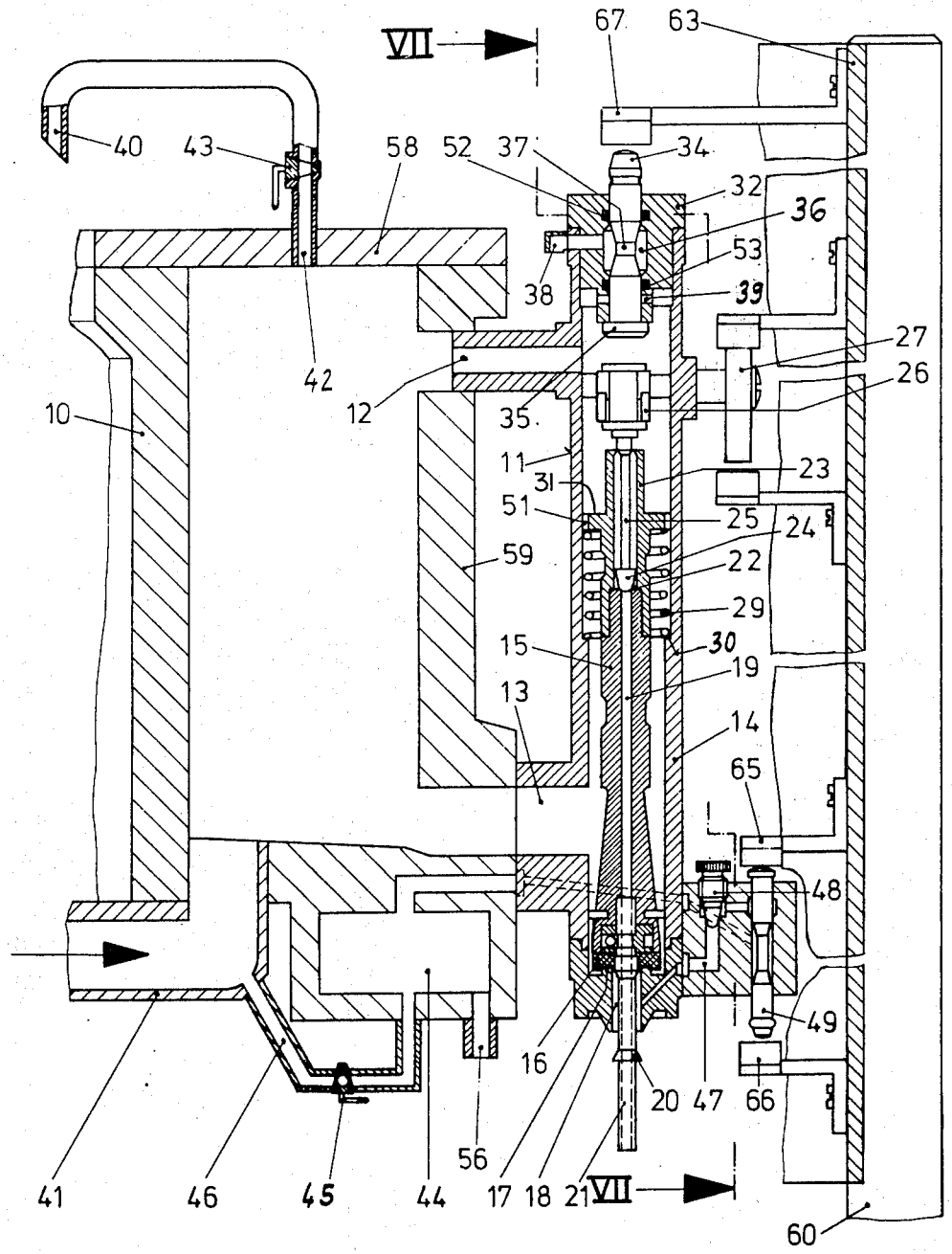
FIGS. 4, 5 and 6 represent respectively a section of the machine container with a filling element providing different valve settings.
Figure 8:
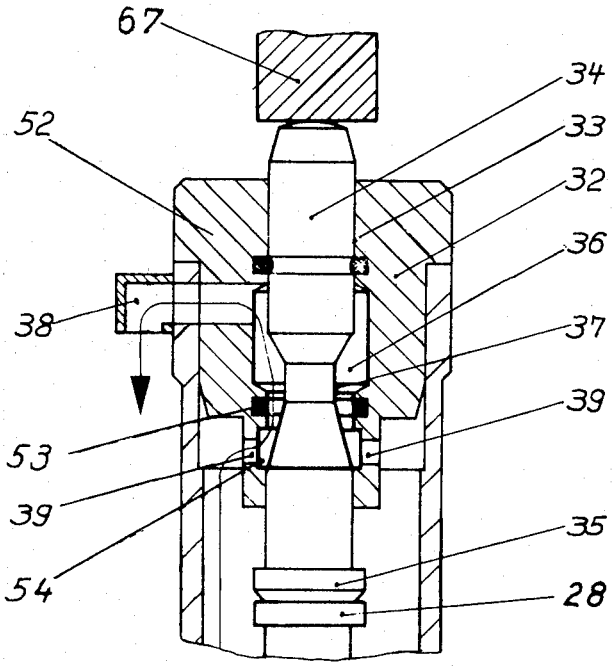
FIG. 8 shows a rinsing medium outlet at the filling element with an opened rinsing valve.
Figure 10:
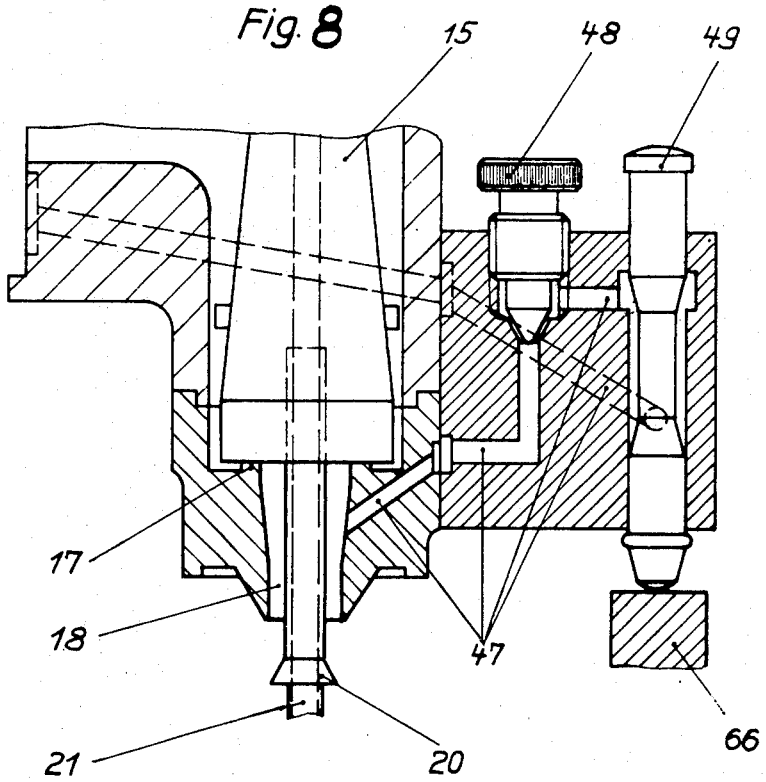
FIG. 10 shows a detail of the filling element.
Figure 11:
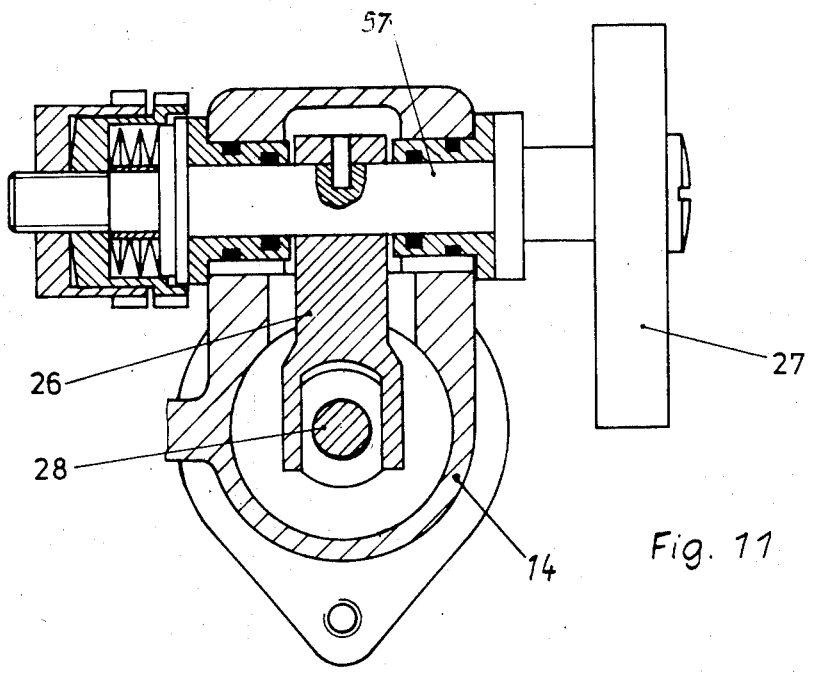
FIG. 11 shows the control elements of the tensioning- and return gas valve in the section XI—XI of FIG. 5.

In FIG. 4 there is illustrated the filling container 10 having cover means 10' for the substance to be filled and the tensioning gas as well as a filling element 11 which is laterally connected to the container mantle. The filling element 11. with a gas feeding path 12 and a separate liquid path 13, is connected in a gas- and liquid-tight manner to corresponding exits of the container 10. The element 11 primarily comprises a tubular housing 14 with a vertically insertable body 15. By means of a seal or gasket 16, the valve body 15 rests upon a valve 17 for closing a liquid outlet 18 located at the lower housing end. In the valve body 15, which together with the seat 17 forms the liquid valve 15, 17, there extends a central bore 19 which is continued downwardly by a gas pipe 21 which is equipped with a deflector 20, said gas pipe 21 protruding from the liquid outlet 18. The gas pipe 21, which is expediently detachably connected to the valve body 15, forms together with bore 19 the tensioning and return gas conduits 19, 21 in communication with the gas chamber of container 10. A valve seat 22 is arranged at the upper conduit end of conduits 19 and 21, and a valve body 24 is guided in an extension 23 of the valve body 15 and provided with a shank 25 provided with valve body 24 to form the gas valve 22, 24. For purposes of engagement of a fork-shaped lever 26 which is in engagement with a control pinion 27 acting during the rotation of the machine, the valve shank 25 has its free end protruding from the extension 23 provided with a head piece 28. The lever 26 is attached rigidly on a horizontal pinion shaft 57 of FIG. 11 relative to rear end thereof remotely with respect to the fork shanks. The valve body 15 of the liquid valve 15, 17, has furthermore associated therewith a spring 29 which is effective during pressure equilization and which on one hand engages the housing protrusion 30 and on the other hand engages a guiding collar 31 of the valve body 15. The collar 31, arranged within the region of the extension 23, has a plurality of vertical passages 51. Above the gas feeding passage 12, the element housing 14 is closed by a detachable cover 32. The cover 32, which is expediently in the manner of a sleeve insertable into the upper housing and is held by a fast closure, for instance, a bayonet closure, has a central bore 33 extending all the way through for vertically guiding a spring-free valve body 34 which is designed in the manner of a piston slide and which has its upper end protrude from the cover 32 and has its lower end which forms a collar 35 arranged opposite to and in alignment with the head piece 28 of the valve shank 25. Within the cover 32 the bore 33, provided with annular sealing means 52, is broadened to form a cylindrical chamber 36 (FIG. 8). This cylindrical chamber surrounds a constriction 37 located in the central portion of the longitudinally displaceable valve body 34 and by means of a connected horizontal passage 38 leads into the open. Below the passage 38 at a lower extension of the cover 32 which tapers relative to the housing inner wall, there is provided a plurality of radial bores 39 which lead into the hollow chamber 36. The valve body 34 forms together with the valve seats 53 respectively arranged at the mouth of the bores 39, the rinsing valve 34, 53, for which the necessary control force is always constant independently and unaffected by the pressure of the cleaning medium. Valve body 34 in the end position shown in FIG. 1 covers the valve seats 53. The reference numeral 67 designates a cam which is arranged at the circumference of the filling machine and which is able to be pivoted into the circulatory path of the valve bodies 34.

Figure 3:
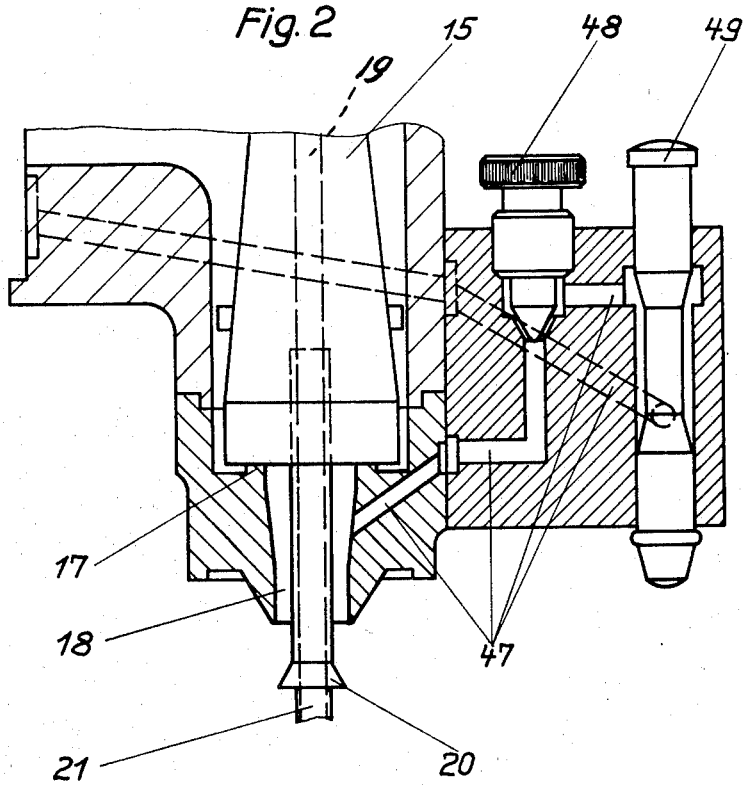
FIG. 3 shows a sectioned view of an upper part of the filling machine.

A conduit 41 leads into the container 10 with the valve 43 being open, said conduit being connected to the bottom of the container. This conduit may be the conduit for conveying the filling substance, or may be a conduit branched off from the conduit conveying the filling substance, or it may be a separate conduit through which a cleaning fluid enters the container 10. The container cover is furthermore provided with an outlet opening 42 and a shut-off valve 43 connected thereto. Moreover, the filling container 10 has its bottom side provided with an annular passage 44. The passage 44 is connected through a conduit 46 equipped with an additional shut-off valve 45 to communicate with the container conduit 41. Connected to the passage 44 are the pressure relief conduits 47 which are associated with the elements 11 and which, as shown in FIG. 3, lead to the passage 44 from the liquid outlet 18 of the elements 11 in conduit sections through a throttle 48 and a relief valve 49 which is operable during the rotation of the machine and which expediently is a spring-free piston slide valve in the manner of the above described rinsing valve 34, 53.

When employing cleaning fluid, the cleaning of the filling container and of the filling elements is expediently effected in the following manner:

When the shut-off valve 43 is open, the cleaning fluid is, through conduit 41, introduced into the container 10 while the scavenging or rinsing valves 34, 53 of the elements 11, as well as the valves thereof for tensioning and return gas liquid and relief 22, 24; 15, 17; 49 are closed. When the liquid which rises in the container 10 and through connections 12 and 13 flows into the elements 11, leaves through shut-off valve 43, following sufficient rinsing of the container 10, the control cam 67 is pivoted into the circulating path of the scavenging valves 34, 53, and these valves are during a machine revolution opened by a cam 67 engaging the upper end of the valve body 34 (FIG. 2). In this connection, each valve body 34 carries out a downward movement and frees the radial bores 39 which, through chamber 36 and passage 38, establish an outlet leading from the element housing 14 into the open. In its end position during its downward movement, which can be effected manually any time and in which the valve body is fixed by the engaging O-ring seal 52, the valve body 34 has its collar 35 in engagement with the oppositely located head piece 28 of the valve shank 25 and thus blocks the gas and liquid valves 22, 24; 15, 17 associated with the element 11, in its respective closing position.

After the element 43 has been closed off while cleaning fluid is further introduced into the container 10, the liquid now flows into the open through the element housing 14 and through the open rinsing valves 34, 53. After sufficient cleaning of the element housing 14, especially the upper housing part, during a following phase, the control cam 67 is removed from the circulatory path of the rinsing valves 34, 53. By means of a subsequent control movement of the control pinion 27 while the valve bodies 24 carry out an upward stroke, the gas valves 22, 24 of all elements 11 are opened. In the course of this lifting movement, also the head pieces 28 return a respective engaging valve body 34 to the closing position of FIG. 1 whereby the radial bores 39 are blocked and the scavenging valve 34, 53 is closed. The gas paths are now cleaned by the liquid which passes through the opened gas valve 22, 24, the tensioning and return gas conduit 19 and the gas pipe section 21. At the same time, the cleaning of the liquid circuit outlet 18 and of the liquid valve 15, 17 is effected, which valve 15, 17 under the influence of equal pressure prevailing in the fully filled container 10 and in the elements 11 filled with cleaning fluid, is opened by the spring force 29. The liquid leaving the liquid outlet 18 additionally cleans the outside of the gas pipe 21.

Subsequent to the above described cleaning operations, the sequence of which will assure the cleaning of the elements 11 in an advantageous manner from the top to the bottom in order to avoid the re-infection of already treated elements by liquid dropping down, there is effected for the individual filling elements 11, the cleaning of the relief conduits 47, and of the turned-on valves 49. For this operation, which, of course, may also be carried out at an earlier phase, the cleaning fluid is passed from conduit 41 through the opened connecting line 46 into the annular passage 44 and from the latter after the relief valves 49 have been opened previously, back through the individual relief valve 47 of the elements 11 to the respective conduit inlet at the liquid inlet 18 from where it flows toward the outside.

The rinsing device provided with respect to the filling machine consists in essence of several rinsing valves whereby every filling element 11 at the upper end of the housing 14 is provided with one of these valves. Every valve is arranged in a purposeful manner to have a cover 32 for closing the element housing in a location above the gas feeding path or inlet 12 as apparent in FIGS. 4 and 8; the cover 32 is installed in a sleeve mannr in the upper housing opening and is releasably connected with the housing 14 by way of a quick closure means. As the valve embodiment there is selected a spring-free valve body 34 embodied in the manner of a piston slide or shift means; the valve body 34 is guided horizontally in a bore 33 passing centrally through the cover 32 and in alignment across from the lower end of the head piece 28 of the valve shank 25 formed into a collar 35. Within the cover 32 the bore 33 is widened into a cylindrical chamber 36 which is restricted or boundaried by way of an upper and a lower ring-formed seal means 52 and 53. The upper seal 52 surrounds the valve body 34 provided with a ring groove 55 and holds the same upon engagement in the groove 55 in the lower end position (FIG. 8). In the upper end position of the valve body 34 the seal that forms the rinsing valve 34, 53 seals off the inner chamber of the housing 14 relative to the chamber 36 in which the valve body 34 comes into engagement against the seal (FIG. 4). The chamber 36 surrounds a middle part of the longitudinally shiftable valve body 34 having a restriction 37 provided therewith and communicates with the free atmosphere by way of a connected horizontal passage 38. Below passage 38 there are provided several radial bores 39 accommodated relative to a lower extension of the cover 32 tapered relative to the housing inner wall; the bores respectively communicate or emanate with widened portions 54 relative to the lower part of the bore 33 adjoining the hollow chamber 36 (FIG. 8).

Also belonging to the rinsing device there is provided an outlet or exit opening 42 arranged in the upper container cover 58 with a conduit 40 connected thereto and a blocking element 43 installed therein as well as an annular passage 44 arranged in a purposeful manner on the underside of the filling material container 10, the annular passage 44 being connected with a tubular conduit 8 by way of a line 46 provided with a further blocking element 45 (FIGS. 3 and 4). The passage 44 has an outlet 56 to the atmosphere and elements 11 are connected with respect to the pertaining pressure relief conduits 47. As shown in greater detail in FIG. 4, there is noted that the pressure relief conduits 47 lead to the passage 44 in several conduit segments by way of a throttle element 48 as well as a post-connected relief valve 49 capable of being actuated during machine operation and in a purposeful manner having a spring-free piston-shift valve of a type of the previously described rinsing valve 34, 53.

Figure 7:
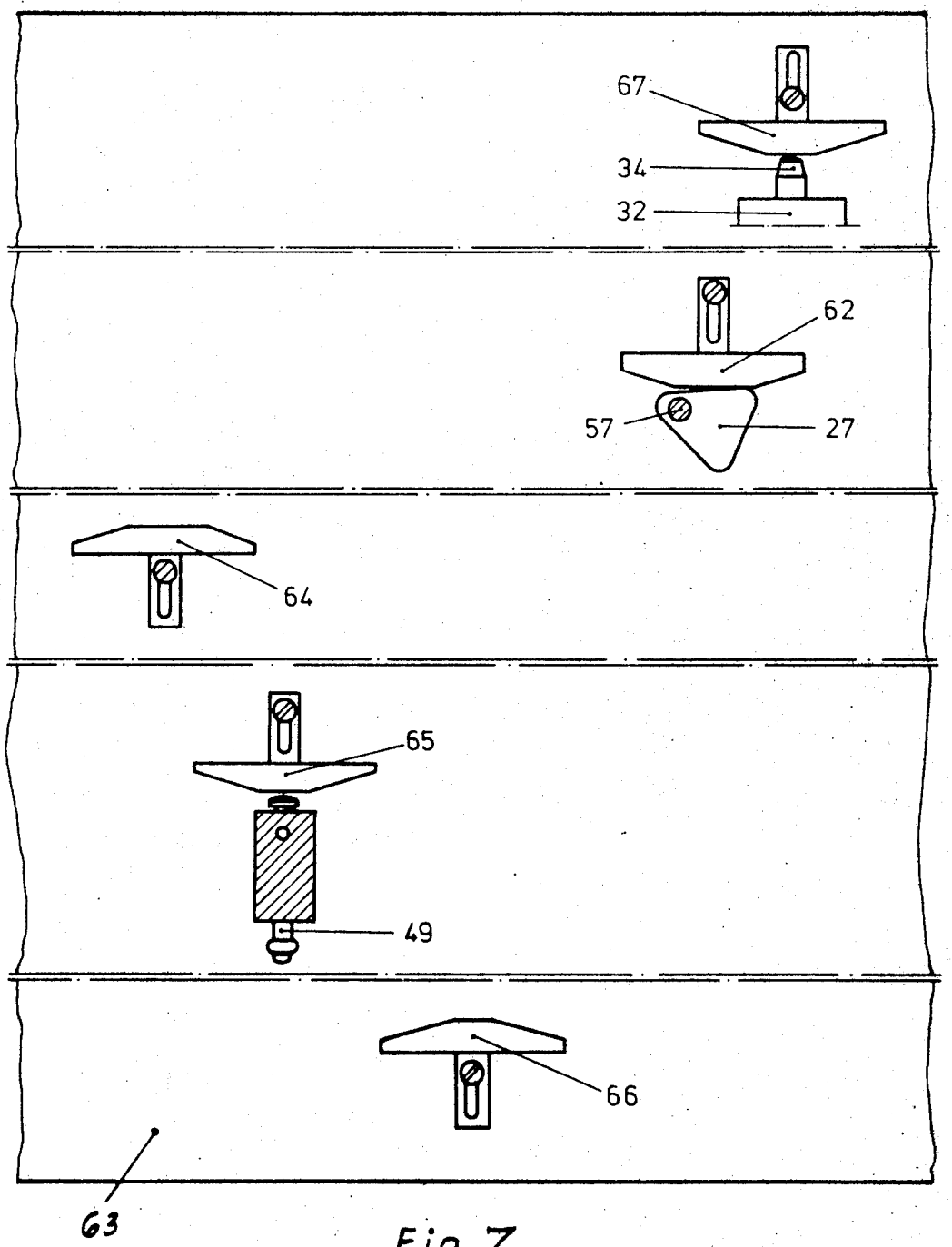
FIG. 7 shows an arrangement of control means for actuating the valves according to a cross-sectional view taken along lines VII—VII of FIG. 4.

For control of the valves 15, 17; 22, 24; 49 and 34, 53 pertaining at a time respectively to the filling elements 11 there are control elements in the form of short curved pieces provided to serve as arranged on the periphery of the filling machine and capable of being connected and disconnected in the circulating path of the valves. As shown in FIG. 2, these are fastened on a common support or holding means 63 surrounding the machine in an annular form and which in turn can be supported upon the surface means of several columns 60. These are connected with the machine lower part 1 each by way of a connection piece 61 (FIG. 1). The arrangement of the curved pieces on the support 63 is provided in such a manner that the same can effect the particular valve control necessary corresponding to the cycle of the filling procedure or rinsing procedure (FIG. 7). Accordingly, the curved pieces engaging against the pinions 27 of the elements 11 in common are designated for the gas valves 22, 24 and the fluid valves 15, 17 together with 62 and 64 including curved pieces 65, 66 effective upon the relief valve 49 and curved pieces 67 effective upon the control valves 34, 53 for control purposes.

The machine construction with the rinsing device arranged thereon permits the following manner of operation:

a. During the filling procedure:

At the beginning of the filling procedure, there are certain valves 15, 17; 22, 24; 49 and 34, 53 closed and additionally for the valves 34, 53 there is noted that the control cam or curve 67 is removed out of the circulating path of these valves. Furthermore, the conduit 46 and outlet opening 42 are blocked by way of the blocking elements 43 and 45 which are manually actuated. The filler container 10 is filled with filling material and tensioning gas located thereabove. With the filling machine now being placed in operation, there is noted that during rotation of the conveyor or feeding path 6 there are bottles supplied and these become pressed against the element outlet 18 by means of the lift elements 3; during actuation of the shift pinion 27 on the curve or cam piece 64, there is actuation of the lever 26 arranged with respect to the particular filling element 11. In the course of the pivot movement of the fork-formed end transmitted by way of rotation of the pinion shaft 57, the same lifts the valve body 24 and opens the gas valve 22, 24 through which tensioning gas flows out of the filler container 10 by way of the conduit path 19, 21 and the feeder or input 12 into the bottle pressed thereagainst. With the pivot movement the lever 26 simultaneously relieves the valve body 15 of the force of the pinion 27 keeping the same closed so that at this time point alone the tensioning gas pressure prevailing in the filler container 10 presses the valve body 15 onto the valve seat 17 and the valve 15, 17 maintains the closure position against the spring force 29. With pressure equilization occurring progressively between the bottle and the filler container 10 occurring by way of the gas conduit 19, 21 there is noted that the pressure effective upon the valve body 15 decreases continuously. As soon as the spring force 29 exceeds the tensioning gas pressure as is the case approximately with equal pressure between the preloaded bottle and gas pressure in the filler container 10, there is lifting of the valve body 15 from the valve seat 17 and the same is arranged to make free the liquid discharge 18. The filling material flows now under static pressure by way of the diverting shield or umbrella 20 into the bottle. Thereby there is noted that the tensioning gas escapes as return gas by way of the gas conduit 21, 19 and the gas valve 22, 24 into the gas chamber of the filler container 10. If the rising filling material attains the bottle-side section of the gas tube 21, so the gas path for the return gas becomes blocked and the feeding of filling material becomes ended. When the shifting pinion 27 comes upon the control cam 62 during further rotation of the filling machine, then the shifting pinion 27 pivots together with the lever 26 and thereby the gas valve means 22, 24 and the valve body 15 together with the seal 16 are brought into closure position by way of downward movement upon the valve seat 17. During further rotation of the filling machine, there is noted that the relief valve 49 comes into the range of a control curve or cam 66 that shifts the relief valve 49 in vertical direction. Thereby the passage 47 becomes connected with the atmosphere by way of an annular passage outlet 56 so that the tensioning gas remaining in the bottle neck escapes. Subsequently the bottle is lowered away from the filling element 11 and is transported out of the filling machine. Prior to pressing the next bottle against the filling element 11, the relief valve 49 comes into the range of the control curve or cam 65 which shifts the valve 49 into the starting position.

b. During the rinsing procedure the following occurs:

The rinsing procedure with the machine standing still at first extends with respect to the rinsing of the fluid container 10 and the filling elements 11 whereby first the container and then the elements are handled or treated. For the rinsing procedure all valves 15, 17; 22, 24; 34, 53; 49 of the elements 11 are located in the closed position as shown in FIG. 4 and so far as this has not occurred by way of engagement of the control elements prior to standstill of the machine, the valves are manually brought into closing position. Closed likewise is the blocking element 45 of the conduit 46. By way of opening of the blocking element 43 manually there is then releasing or opening of the opening 42 and cleaning fluid, for example water taken from the network, is introduced into the container 10 by way of the conduit 8 and the branch 41. The water rising in the container 10 flows by way of the connections 13 into the elements 11 and rises there in communication with the fluid level in the container 10 whereby the air displaced out of the container 10 and the elements 11 escapes by way of the opening 42.

When the water that has flown into the container 10 and the elements 11 then reaches the container cover 58, then the same flows away into the channels or passages by way of the opening 42 and the conduit 40. In this manner, the filling material remainder becomes removed out of the container 10 and the elements 11 and the blocking element 43 remains open so long in a purposeful manner until the water flows clear out of the opening 42 and the conduit 40.

Figure 5:
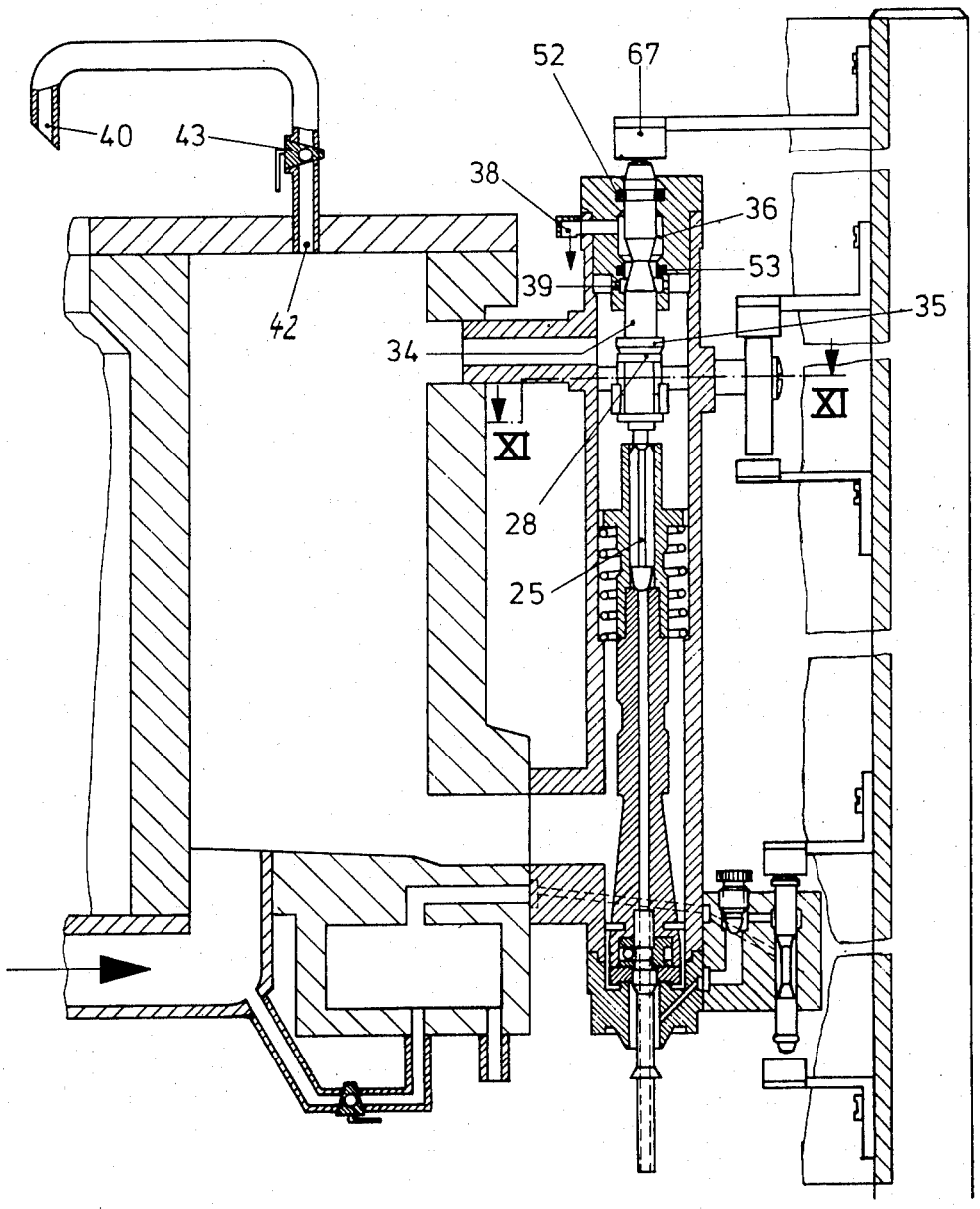

For the now subsequent rising of the elements as apparent in FIG. 5, there is noted that the opening 42 is closed manually by way of actuation of the blocking element 43; and upon further water supplying or feeding into the container by way of the conduit 8 and branch 41 there is swinging of the control curve or cam 67 into the circulating path of the rinsing valves 34, 53. With the machine set into operation thereafter there is downward movement of the valve body 34 by way of the cam or curve 67 upon starting of the machine rotation. The same thereby come into engagement with the collar 35 at a time against the head piece 28 of the valve shank 25. In this position, the valve bodies 34 are fixed at a time by way of the latching ring seal 52 and additionally the radial bores 39 are made free so that the water at a time discharges by way of the chamber 36 and the passage 38 and in this phase of the rinsing procedure the upper part of the elements becomes rinsed free of filling material remainders. Thereafter the curve or cam 67 is reset into the ineffective position.

Figure 6:
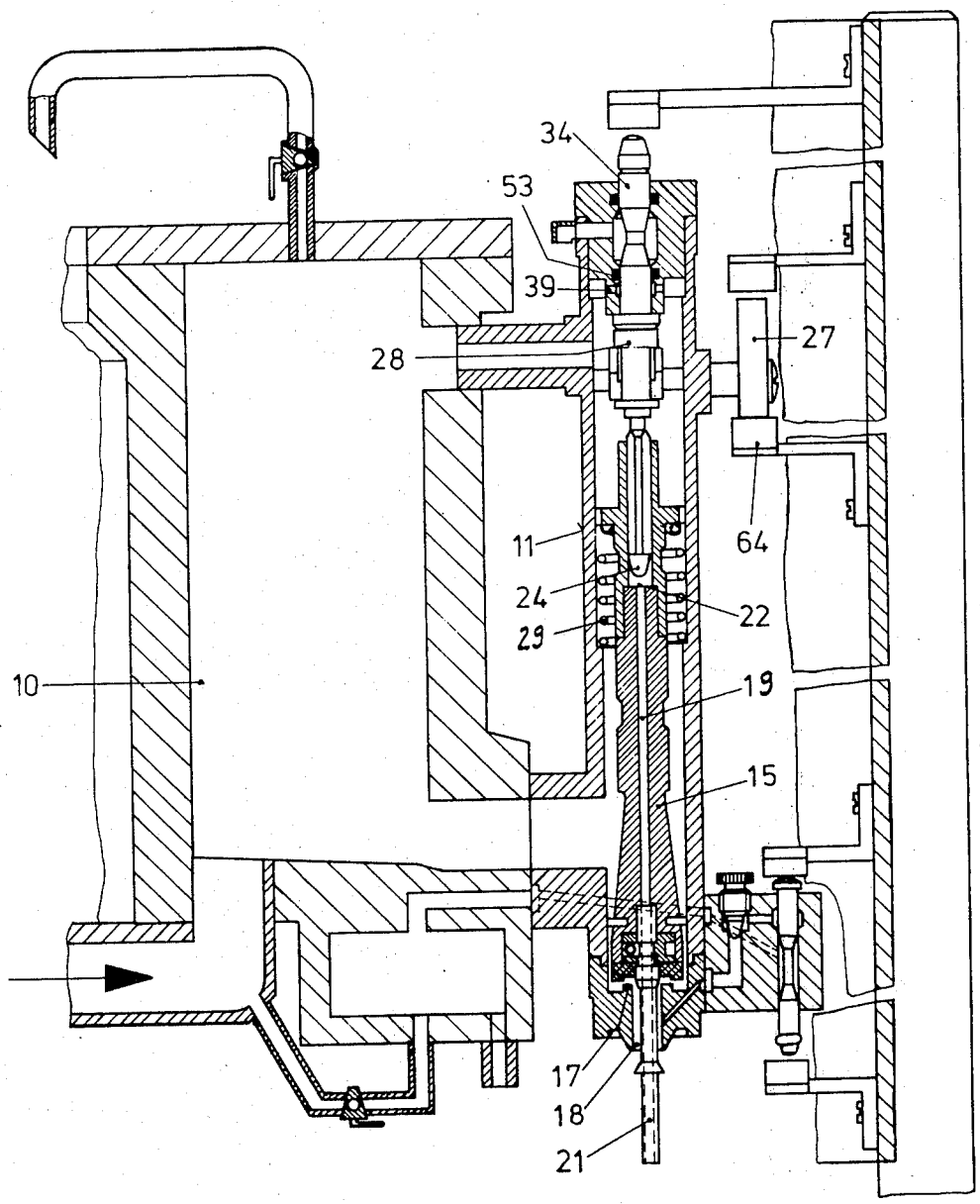

By means of a subsequent shifting movement of the control pinion 27 by way of the control cam 64 pivoted into the pinion path, there is noted that the valve bodies 24 during further rotation of the machine carry out an upward movement (FIG. 6). Thereby the elements 11 collectively open the gas valves 22, 24. In the course of this lift movement, there is noted that the head pieces 28 also reset at a time an engaging valve body 34 into the closure position whereby the radial bores 39 become blocked and the rinsing valve means 34, 53 is closed. These passages now become cleansed by way of the flow through the open gas valves 22, 24 by way of the tensioning and return gas conduit 19, 21 having fluid discharging out of the gas pipe segment 21. Simultaneously, there occurs the cleaning of the fluid discharge 18 and the fluid valves 15, 17 becoming open under the effectiveness of the spring 29 of which the pressure overcomes the rinsing water pressure in the container 10. The fluid escaping hereby out of the fluid discharge 18 additionally cleans the outer side of the gas pipe or tube 21.

Figure 9:
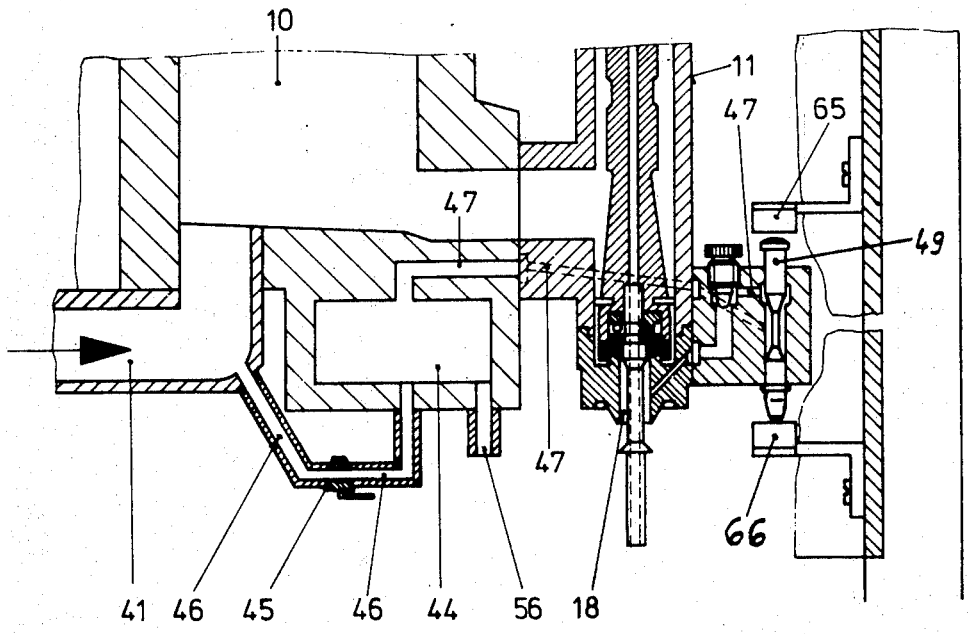
FIG. 9 shows a filling element in section with the relief valve standing in the rinsing position or setting.
Figure 1:
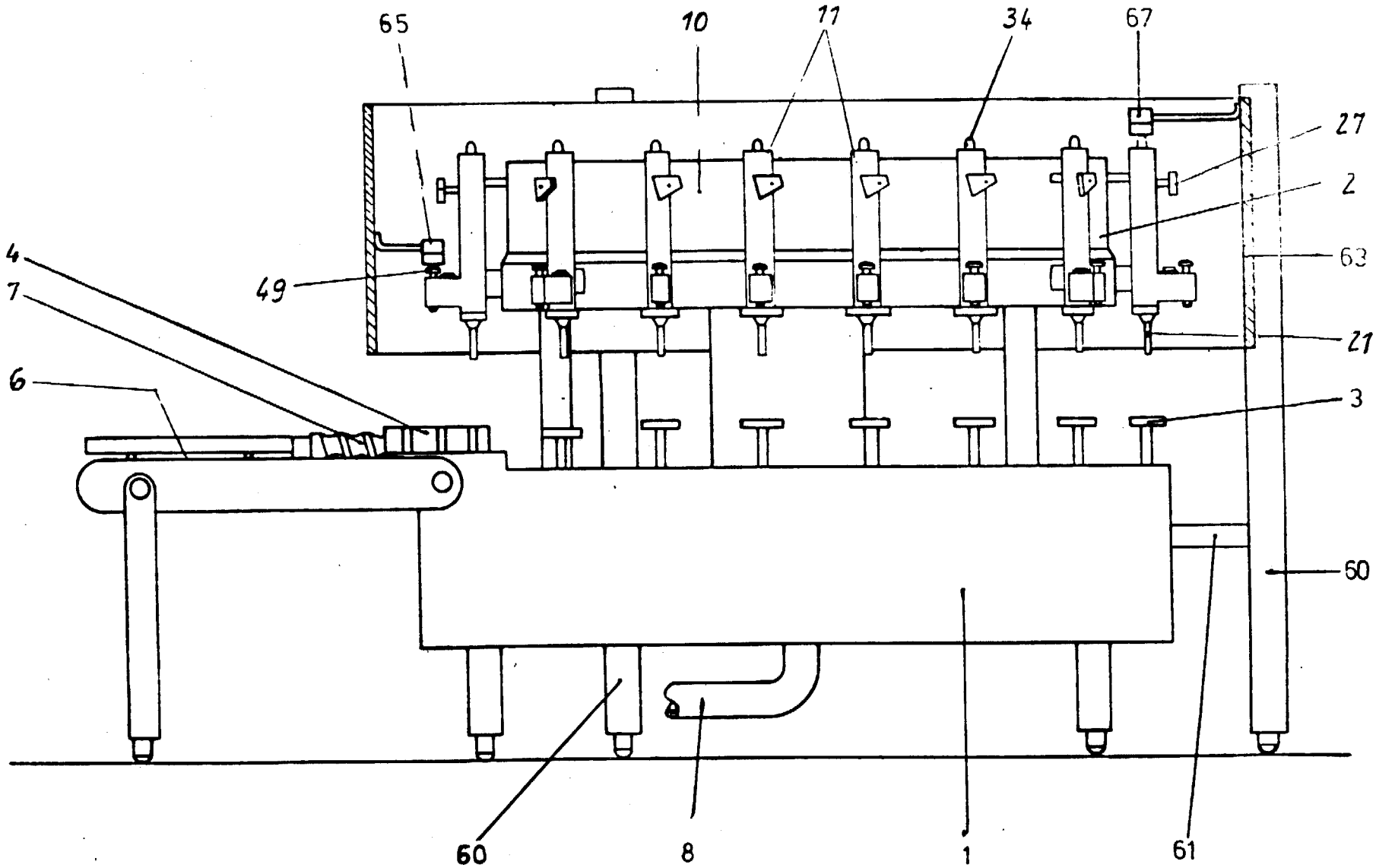
Figure 2:
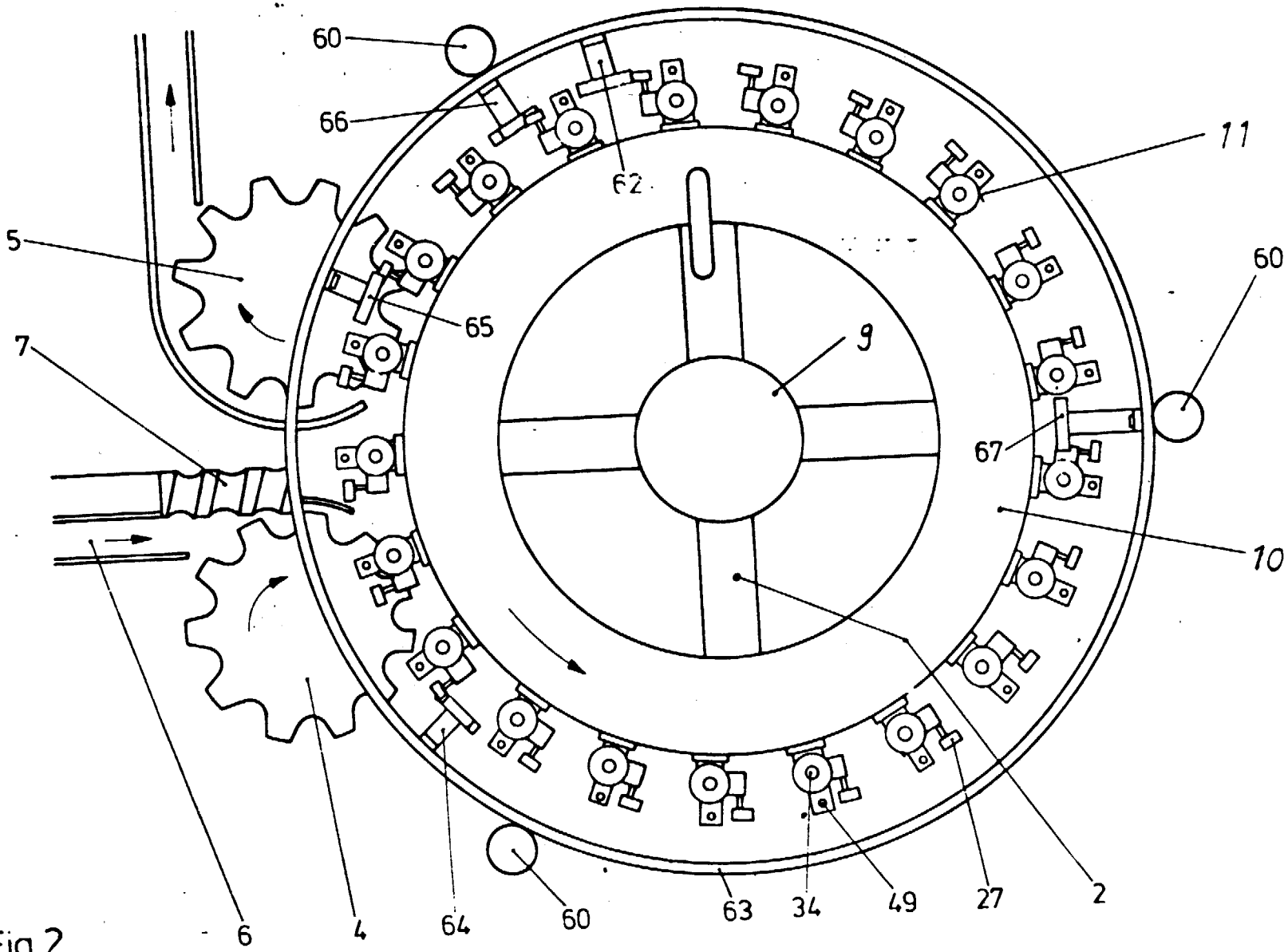
Figure 3:
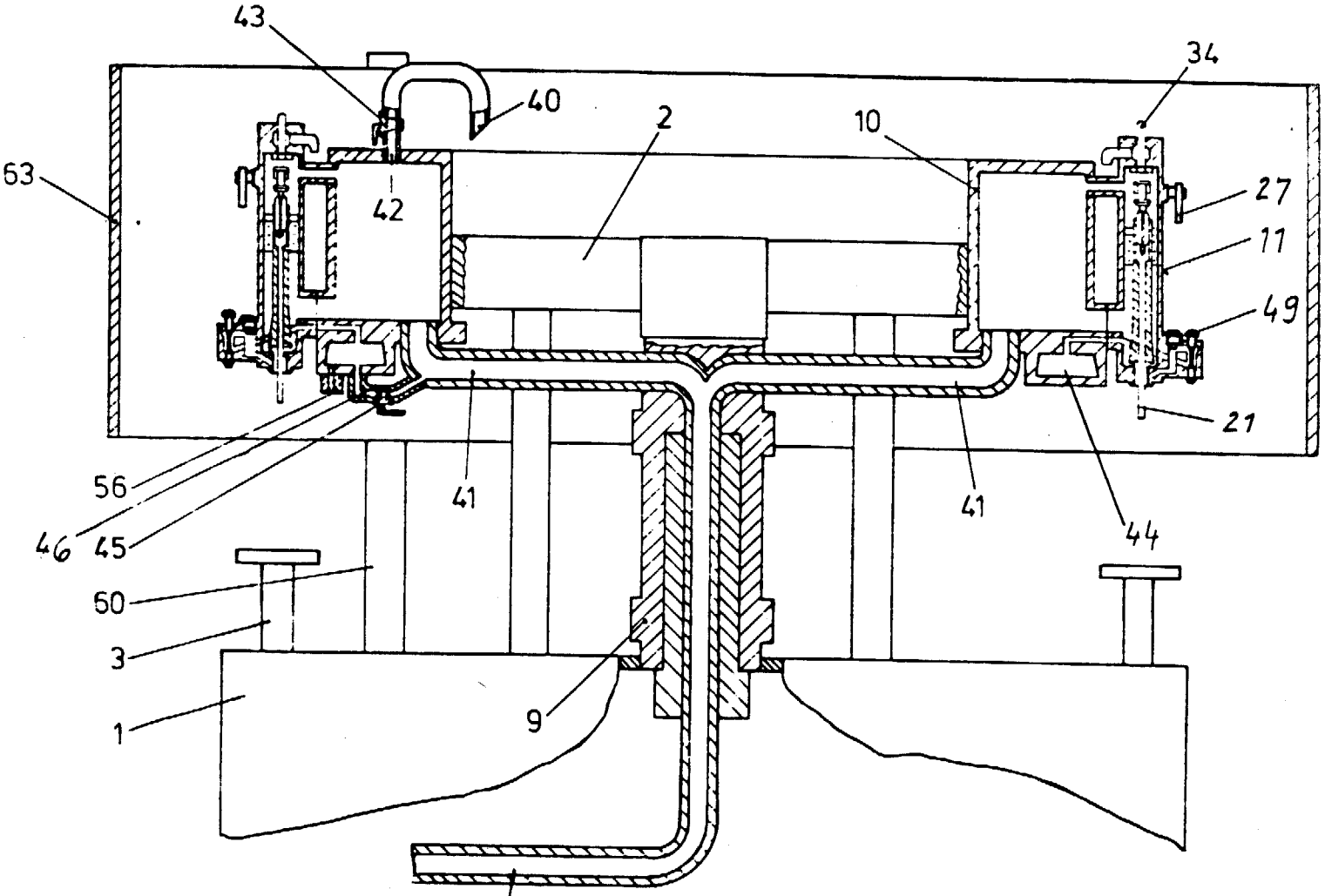

Subsequent to the cleaning procedure described by the foregoing having a sequence making possible the cleaning of the elements 11 in an advantageous manner from above to a downward location in order to avoid re-infection of element parts already treated by way of fluid that drops off, there is noted that for the individual filling elements 11 the cleaning of the relief conduits 47 as well as the valves 49 occurs as soon as the same become opened by way of the cam or curved path 66 being swung in or pivoted (FIG. 9). For this procedure, which naturally also can be carried out in an earlier phase, there is noted that the cleaning fluid is guided from the conduit or branch 41 by way of the opened connection conduit 46 into the ring passage 44 and therefrom by way of the individual relief conduits 47 of the elements 11 and the opened valves 49 as far as to the inlet of the relief conduit at the fluid discharge 18 of the element 11 and the same flows from there into the open. Simultaneously, the fluid flows out of the ring passage 44 and the outlet 56 into the open.

The present disclosure concerns a cleaning device for the filling element with valve controlled container relief from circulating one-chamber counter pressure filling machines; the invention pertains to a special type of filling element as known for example by way of U.S. Pat. No. 3,500,880—Meyer issued Mar. 17, 1970. Since by way of the prior disclosure of this patent also the manner of operation of such filling elements became similar, the same is not set forth in further detail in the descriptive part of the present disclosure. In the present disclosure there is handled accordingly only the cleaning procedure which basically becomes carried out without any pressing of the bottles against the filling elements. There can be set forth questions of "How does filling occur with the openings at 12, 13, 41, 42–43?", and "How is there cleaning or rinsing by way of the openings 12, 13, 41, 42–43?" In normal filling operation the openings 42–43 would be closed. An actuation of the valve 43 occurs only during the cleaning procedure and moreover this occurs in a first phase so that during opening of the valve 43 there is introduction of the cleaning fluid by way of a conduit 41 into the container 10. The valve 43 is open. Closing occurs when the cleaning fluid supplied by way of the conduit 41 completely fills the filling container 10 and discharges from openings 42–43. In this phase the cleaning means flows at a time by way of the gas connections 12 and the fluid connections 13 into the filling element of which the valves 15, 17; 22, 24; 34 and 49 are closed collectively in this time period. Not until after a subsequent second phase and beginning machine circulation without bottles pressed into engagement does the valve 34 first open by means of a swung-in cam 40 so that the cleaning fluid flows outwardly by way of a chamber 36 and passage 38. By way of the valve 34 there is maintained the blocking position additionally of the valves 15, 17. Also the other valves remain closed. First with a subsequent actuation of the pinion 27 in the further proceeding machine circulation or operation does the valve means 22, 24 change into the opening position whereby also the fluid valves 15, 17 occupy the opening position and the cleaning fluid discharges downwardly by way of the now opened gas passage means 19, 21 and the likewise open fluid paths 13, 18. Thereafter there occurs the cleaning of the relief conduits 47 and the valve means 49.

With the pressureless annular passage 44 the concern is with an annular passage connected with the atmosphere in a normal manner. The same corresponds approximately to the chamber 21 disclosed in U.S. Pat. No. 3,478,785—Mallrich et al issued Nov. 18, 1969 where this chamber 21 is connected with the atmosphere and with smaller machines was accommodated in the middle column. With modern high capacity machines this chamber now is embodied in the form of an annular passage which is connected with the filler container. Moreover the said annular passage respectively the mentioned chamber serves for receiving return gases as to the multiple chamber-counter pressure-filling machine preconditioned in U.S. Pat. No. 3,478,785—Mallrich et al issued Nov. 18, 1969. Also the relief occurs in a conventional manner in the annular passage respectively in the chamber. With the single chamber filling machine of the present disclosure there is such an annular passage respectively such a chamber provided only for receiving the pressure relief since the return gas becomes guided back into the filler container. For this reason the filling elements collectively are connected with their relief container 47 on the pressureless annular passage.

There is noted first cover means closing the top of said filling chamber and having a first outlet. The concern therewith could only be with the lower, conical inlet end of the housing end against which the bottles to be filled are pressed. The embodiment of the filling elements, however has nothing to do with the teaching of the present invention.

With the part 17 the concern is with the seat of the fluid valves means 15, 17. Upon the seat 17 of the fluid valve there engages a shaft-type valve body 15. In normal filling operation there is opening of the fluid means 15, 17 thereby that the valve body lifts from the valve seat 17 under effectiveness of a spring means 29. The procedure is described in the mentioned U.S. Pat. No. 3,500,880—Meyer issued Mar. 17, 1970.

With the position 18 the concern is with a fluid discharge at the lower housing end. This can be clearly and certainly ascertained from FIG. 3. As to which relationship there is to exist between the outlet 18 and the filling container 10, there is noted that with the filling procedure the filling material flows over the outlet 18 out of the container 10 into a bottle that is pressed into engagement after the filling valve means 15, 17 occupy the opening position. Also this procedure is known by way of U.S. Pat. No. 3,500,880—Meyer issued Mar. 17, 1970, however, having no relationship to the cleaning procedure involved in the present invention. With this cleaning procedure the cleaning fluid may also flow from the container 10 and the connections 12 and 13 during opening of the fluid valve means 15, 17 and out of the outlet 18. Hereby, however, there is no bottle pressed into engagement therewith.

As to the question of valves involved with the cleaning device, the concern herewith is only with the control valve 34. The other valves are not in any way to be taken in conjunction with the cleaning device for the present invention.

With respect to the cam 67, there is only stated that the same is capable of being pivoted into the circulating path of the valve body 34. For clarification of the manner of operation of the control cam 67, there can be ascertained in the drawings that with pivot point 55 there is pivotally journaled a lever 57 connected with a control cam 67 on a carrier column fastened stationary on the machine periphery. At the free end of the lever 57 the piston rod engaged for example against a pneumatically actuated stroke cylinder means 59 such that upon engagement of the piston by means by way of the conduit 60 having air supplied thereto there results that the piston thereof against effectiveness of a pressure spring results in reaching the upper end position of the piston whereby the slanted plane 61 of the control cam reaches into the circulating path of the valve body 34 and actuates the same in the opening sense. When the air supply is blocked off, the pressure spring of the stroke cylinder 59 returns the stroke piston into the lower end position. The control cam 67 is thereby moved out of the engaging position with the valve body.

The following comments are made to clarify:

First, as to "what and where is the "open" referred to in the foregoing description?" There is noted that "into the open" means "into the atmosphere" or "into the free (air)" which means that the housing cover 32 of the filling element possesses an outlet leading into the atmosphere. In the sample embodiment, the outlet extends horizontally and is designated as passage 38 and exit or drainage occurs therefrom where the valve means 34, 53 becomes opened until the fluid rises as far as to the cover 32.

Next, as to the meaning of the foregoing description, there is noted that this pertains to the preferred embodiment of the valve means 34, 54 and particularly as to the arrangement of the piston shifter or valve body 34 located vertically in the cover 32. The valve body 34 is longitudinally shiftable into closing and opening position in front of the housing side opening internally thereof as to the passage 38. The valve body can be actuated manually by way of an upper extension thereof projecting out of the cover 32 or the valve body 34 can be actuated by way of cam means 40 installed on the machine.

The "container mantle" represents terminology used here in the sense of the container wall and there is meant the outer vertical container wall in which the openings for the gas inlet or gas feeding path 12 and fluid or liquid feeding path 13 are provided. This wall or container mantle 21 has the individual elements 11 secured as screw connections therewith and not shown in any further detail because of the conventional nature thereof.

The terminology "tensioning and return" represents a concept utilized exclusively with isobarometric work and for filling up of drinks containing $CO_2$ and with the machine serving for this purpose. Involved with the foregoing filling procedure when using this counter pressure filling machine there is noted that the tension gas located above the filling material in the container 10 serves first to produce the preloading in the bottle upon the filling material pressure. During inlet of the material into the bottle because of the drop height thereof, or in other words, the filling level, there becomes displaced the tension gas and this flows as a return gas back into the container 10.

As to a matter of how does lever 26 engage pinion 27 when no structural connection is shown between these elements in any of the figures, there is noted that the fork lever 26 is rigidly connected with a division or forking of the opposite rear end of the horizontal shaft 57 of the shaft pinion 27. The arrangement and the structural connection between these elements can be recognized from an illustration drawing in FIG. 11.

Above the gas inlet 12 there is located the upper housing end of the filling element 11 closable with a releasable cover 32.

As to how a "pressureless passage" is produced, or coacting with related structure to provide a workable fluid system, the concern here is with an annular passage 44 which is arranged securely below the filler container 10 or removeable at the container bottom and consisting of a ring-formed pipe cross section closed in itself. With the conduit 46 and the valve 45 the same is connected to the container conduit 41 and leading thereto are the pressure relief conduits 47 as to several elements 11. Thereby there exists for every filling element 11 a fluid system extending from conduit 41 by way of the conduit 46, the passage 44 and the conduits 47 to the fluid outlet 18 of the elements.

As to what opens valve 43, there is noted that at the beginning of the cleansing work the valve 43 is opened manually or by hand. At this time point, the container 10 is emptied of filling material and tension gas and atmospheric pressure prevails internally in the container.

As to what introduces cleaning fluid into the container, if the cleaning fluid is water, then a hose or the like connectable to the water system is connected to the conduit 8 and water comes by way of this conduit into the container. If the cleaning fluid is brine (lye) then the conduit 8 is connected with the brine tank. The rinsing procedure has been described previously.

As to what structural connection exists to cause valves 34, 53; and 22, 24; 15, 17 and 49 to close when shut off valve 43 is opened, there is noted that the valves are actuated during operation of the machine through control cams effective upon the pinion 27 and the valve bodies 34 and 49 and as secured or mounted on the machine frame. In contrast, at the beginning of the cleaning work, there is noted that the control cams are pivotable in and out relative to the machine circulating path and thereby the same would be ineffective. The valves 34, 53; 22, 24; 15, 17 and 49 for this reason become closed by hand or manually.

As to terminology used to describe the valves, such as "tensioning and return gas liquid valve", there is noted that the valves normally are not designated or described according to the structure thereof (construction, build-up) but rather according to the function (inlet and outlet valves in motor construction). If, however, the structural terminology were to serve in place thereof, then with the valves 15, 17 and 22, 24 there would have to be mention made of "shaft" valves with which the valves 34, 53 and 49 would be spoken of as shift or plunger valves. This pertains, however, only for the sample embodiment since conventionally also the fluid valves and the tension and return gas valves just as the relief valves and the rinsing valves can provide a different construction. For this reason, the functional designation of the valve terminology would be better.

As to how does the liquid leave through the valve 43, with the normal pressure of the water system the cleaning water streams or flows by way of the conduit 8 into the container 10 of which the valve 43 is opened and once having entered therein rises therewith. Hereby, the water penetrates by way of the inlet 13 into the pertaining element 11 and displaces therein air as is true inside the container also; the air escapes into the atmosphere by way of the valve 43. When the container 10 and the elements 11 are filled full with water, then the water flows by way of the valve 43 likewise into the atmosphere.

As to what structure determines when a "sufficient rinsing" has occurred, there is noted that if a sufficient rinsing of the container 10 has occurred, which means the filling material remainder has been removed out of the container by way of cleaning water flow by way of the conduit 8 into the container 10 of which the valve 43 is opened, then the valve 43 is closed and moved downwardly by means of the control cam 67 being swung or pivoted into the machine circulating path during a machine circulation moving the plunger or shifter 34 of the rinsing valves 34, 53 downwardly. The same release or uncover the openings 39 so that in this phase the valves are opened and the further water flowing therein by way of the passage means 38 can drain outwardly from the upper part of the elements 11.

As to structural elements that coact with cam 67 to move cam 67 into its various disclosed positions, FIG. 4 shows a device for movement of the cam or curve 67 into the effective and ineffective position. Reference 9 describes the construction of the device or apparatus.

As to what is the "circulating path" of valve 34, 53, there is noted that with the rotary filling machines preconditioned herewith there is mentioned made always as to the circulating path of the filling element 11 and particularly in the manner that the filling occurs thereby that the bottles or containers are brought into the circulating path of the elements and are pressed against the same for the filling procedure. Since the valve means 34, 53 at a time would be a component of the filling element and would circulate therwith, there can be mention made by all means as to the circulating path of the valve whereby the upper end of the shifter or plunger would define this path.

As to what is the "end position" of valve body 34, the "end position" of the valve body 34 is the lower end position illustrated in FIG. 8. Hereby the same releases or opens the bore 39 and engages with the collar or shoulder 35 against the oppositely located head piece 28 of the valve body 34. Thereby the same fixes both the valve body 24 of the gas valve 22, 24, and also the valve body 15 of the fluid valve 15, 17 in the occupied closing position.

As to what structural elements close off element 43 and introduce fluid into container 10, the valve 43 becomes closed manually after rinsing of the container 10. Thereafter, however, water coming out of the water system is further supplied to the container 10 and this water now flows through the housing of the elements 13 and flows off into the atmosphere by way of the rinsing valve means 34, 53 and passage 38 opened at the time.

As to what is "a following phase" and when does it occur, a following phase is a time interval following upon a preceding movement procedure or step within the movement proceeding in a different type and manner as carried out; in the present case, after cleaning of the upper part of the element housing the cam 67 removed out of the circulating path of the valve means 34, 53 after cleaning of the upper part of the element housing opens or gives gree the upper end of the valve body 34 so that this can stand ready for the closing procedure.

As to what structural element controls pinion 27, there is noted that pinion 27 and valve body 49 are actuated by way of the control cam means mounted laterally on the machine frame. In the drawing illustrations these control cams are recognizable on the machine frame 63 and the cam 62, 64 effective upon the pinion 27 as well as the cam 65, 66 effective upon the body 49 are seen therewith.

As to what is "liquid circuit 18" and what is its relation to the "liquid outlet 18", this should be referred to as "fluid outlet 18" and the same is identical with the fluid outlet 18.

As to what is the relation between "turned-on valves 49" and "relief valve 49", the concern is with the same valve 49 which becomes open so that the cleaning fluid which flows from the conduit 8 by way of the open connection conduit 46 flows into the annular passage 44 as far as to the conduit inlet at the fluid outlet 18 and flowing into the atmosphere therefrom.

For the meaning of the cover means the concern is with the first covering means as to the cover of the filling container. With the second covering means related to the upper cover of the filling element, there is to be stated that the cover of the filling container which is completely filled with rinsing means in closed condition during the rinsing procedure that there is hindered divergence of the rinsing means out of the container or vessel and the buildup of the pressure necessary for the rinsing procedure is effected. If the concern is with a fluid rinsing means and this normally is the case, then the rinsing means with the cover missing cannot escape out of the passage 38 of the filling element connected into the rinsing position since the passage 38 lies higher than the upper edge of the coverless filling container. Not until the cover is at hand and when there is an over-pressure can the rinsing means pass over the difference in height between the container and the passage 38 so as to overcome the same and so as to escape therefrom. The cover is additionally provided with an exit opening 42 and a close-off element 43 is provided therewith. With the open condition of the close-off element 43, there is inlet of the rinsing fluid possible by way of the conduit 41 of the container 10. The close-off element 43 is thereby opened so that the air displaced by way of the rinsing means can escape out of the container. This flows out of the container so long until the same is completely filled with rinsing means and this escapes out of the close-off element 43. After sufficient rinsing of the container, the close-off element 43 is closed and the rinsing valves 34, 53 are open. The rinsing means supplied by way of the conduit 41 is thereby continuously maintained.

The second cover means 32 closes the valve housing of the filling element and is provided with a rinsing valve means 34, 53 so that the interior of the filling element in the upper part above the connection 12 can be rinsed and washed out. The cover means 32 is embodied as a quick closure means so that the inner parts of the filling element, for example, the wear appearances thereof, can be checked by having the same inner parts easily removable therefrom.

With the teaching of the present invention, the concern is with a rinsing device which consists of a filling device and the parts that are necessary in order to be able to rinse the filling device without disassembly. The rinsing means must be guided through the fluid and gas paths or passages so that a satisfactory cleansing of the filling device is made possible. As rinsing means there can be steam or vapor used in place of fluids or liquids. With these rinsing means, the filling device additionally can be disinfected or sterilized. Rinsing of the filling device must occur under the following circumstances:

a. When the filling device is not used overnight or for several days;

b. When the filling device is changed over to a different product in order to avoid mixing of taste-influencing, color-changing or to avoid turbidity or murkiness;

c. After each filling charge of the same product between the end of the preceding filling charge and the beginning of another filling charge, there is a time interval during which cleansing must occur since there could be spoilage of any rest or remainder still located in the filling device.

The rinsing procedure occurs without great time complexity whereby further there is taken into consideration that human hands cannot transmit any germs to the apparatus parts which would come into engagement with filling material during a subsequent filling procedure.

The rinsing sequence or procedure for example with water can be carried out in the following phases:

A. Rinsing of the container 10: With the blocking-off element 43 opened, there is introduced water into the container by way of the conduit 41 whereby the rinsing valve means 34, 53 of the elements 11 as well as the valves 22, 24; 15, 17; 49 are closed and by way of the blocking-off element 43 there escapes first the air displaced out of the container and the valves by way of the water itself flowing in and subsequently the water itself escapes therethrough. The blocking-off valve purposely remains open so long until the predominant portion of the rest of the previously filled-off product is rinsed out.

B. Rinsing of the element 11 occurs: This procedure is divided up into three sub-phases aa, bb, cc while the closing-off valve means 43 is closed and a continuous supply of water by way of the conduit 41 and the container 10 is permitted by way of the connections 12, 13 to the elements 11.

aa. Swinging in of the control curve or cam 67 and thereby the downward movement of the valve body 34 to the release or opening of the radial bore 38 occurs that produces an exit or outlet leading into the free and open space by way of the chamber 36 and the passage 38 from the element housing 14. The water escapes now by way of the outlet 38 whereby the liquid left remaining in the upper part of the valve can be rinsed therefrom.

bb. When the shut-off valve 43 is open, the cleaning fluid is, through conduit 41, introduced into the container 10 while the scavenging or rinsing valves 34, 53 of the elements 11, as well as the valves thereof for tensioning and return gas liquid and relief 22, 24; 15, 17; 49 are closed. When the liquid which rises in the container 10 and through connections 12 and 13 flows into the elements 11, leaves through shut-off valve 43, following sufficient rinsing of the container 10, the control cam 67 is pivoted into the circulating path of the scavenging valves 34, 53, and these valves are during a machine revolution opened by a cam 67 engaging the upper end of the valve body 34 (FIG. 2). In this connection, each valve body 34 carries out a downward movement and frees the radial bores 39 which, through chamber 36 and passage 38, establish an outlet leading from the element housing 14 into the open. In its end position during its downward movement, which can be effected manually any time and in which the valve body is fixed by the engaging O-ring seal 52, the valve body 34 has its collar 35 in engagement with the oppositely located head piece 28 of the valve shank 25 and thus blocks the gas and liquid valves 22, 24; 15, 17 associated with the element 11, in its respective closing position.

After the element 43 has been closed off while cleaning fluid if further introduced into the container 10, the liquid now flows into the open through the element housing 14 and through the open rinsing valves 34, 53. After sufficient cleaning of the element housing 14, especially the upper housing part, during a following phase, the control cam 67 is removed from the circulatory path of the rinsing valves 34, 53. By means of a subsequent control movement of the control pinion 27 while the valve bodies 24 carry out an upward stroke, the gas valves 22, 24 of all elements 11 are opened. In the course of this lifting movement, also the head pieces 28 return a respective engaging valve body 34 to the closing position of FIG. 1 whereby the radial bores 39 are blocked and the scavenging valve 34, 53 is closed. The gas paths are now cleaned by the liquid which passes through the opened gas valve 22, 24, the tensioning and return gas conduit 19 and the gas pipe section 21. At the same time, cleaning of the liquid circuit outlet 18 and of the liquid 15, 17 is effected, which valve 15, 17 under the influence of equal pressure prevailing in the fully filled container 10 and in the elements 11 filled with the cleaning fluid, is opened by the spring force 29. The liquid leaving the liquid outlet 18 additionally cleans the outside of the gas pipe 21.

cc. Subsequent to the above described cleaning operations, the sequence of which will assure the cleaning of the elements 11 in an advantageous manner from the top to the bottom in order to avoid the re-infection of already treated elements by liquid dropping down, there is effected for the individual filling elements 11, the cleaning of the relief conduits 47, and of the turned-on valves 49. For this operation, which, of course, may also be carried out at an earlier phase, the cleaning fluid is passed from conduit 41 through the opened connecting line 46 into the annular passage 44 and from the latter after the relief valves 49 have been opened previously, back through the individual relief valve 47 of the elements 11 to the respective conduit inlet at the liquid inlet 18 from where it flows toward the outside.

The phase (cc) can be joined equally as well with the phase (aa) or (bb) since with (cc) the concern is with a rinsing path or passage which is independent of the inlets or access openings 12, 13 to the filling element.

Likewise, the phases (aa), (bb) can be changed in the priority or sequence thereof since it makes no difference whether first the upper part of the filling element or the lower part of the filling element becomes rinsed. There must, however, be made possible with every desired series that the filling device becomes satisfactorily rinsed.

Since as already mentioned, the rinsing device involves parts supplementing the filling device for rinsing purposes and both devices can be operated interchangeably, there are designations that appear in the description which pertain both to the terminology of the filling device and also terminology of the rinsing device. It is believed that in the technique it is not conventional to give new names to the parts which fulfill different functions as to the particular use made thereof.

The expression "for pressure . . . " represents a component part which belongs both to the filling and also the rinsing devices. As known, the pressurized interior of the filling bottle prior to transfer to atmosphere must be brought to atmospheric pressure. This occurs by way of an expansion device or also pressure relief apparatus or short relief means can be noted as being involved therewith. The gas quantity relieved out of the bottle is diverted or carried away in the passage 44 by way of the relief conduit 47. By way of a not further illustrated valve, the passage is connected with the atmosphere. The relieving or expanding gas takes product particles therewith out of the bottle. These product remainders must be removed out of the conduit path 47 and the passage 44 and accordingly these gas paths or passages belong to the rinsing program since they are traversed by the gas during the expansion thereof from the bottle as far as to the atmosphere.

With the expression "valve body . . . " the concern is with the rinsing valve means 34, 53. This valve means is necessary only during the rinsing procedure and makes possible in the opening position that rinsing means can escape out of the upper part of the filling element by way of the passage 38. The same is called a rinsing valve so that a wording difference exists relative to the tension and return gas valve means or the relief valve means. On the filling element there are several valves as mentioned in the foregoing.

The designation "tension and return gas valve" or tension-return gas valve means (22, 24) comes from the function of this valve means in connection with the method steps during the filling procedure according to the one-chamber counter-pressure filling method, especially during preloading and filling of the bottle. During the preloading there is provided the path or passage of the gas out of the gas chamber of the container 10 and the filling element in the bottle for free generation of utilized pressure. The production of equalized pressure can be designated as preloading; the gas used for this purpose is called tension gas. During preloading the tension gas mixes with the gas located in the bottle which was located in the bottle before the preloading. The tension gas-gas mixture which is displaced out of the bottle after attaining the equalized pressure through the fluid or liquid flowing in is called return gas. This flows over the pressure of the fluid or liquid flowing into the gas chamber 10 by way of the path taken by the tension gas previously flowing into the bottle. Tension gas and return gas accordingly pass through the same gas valve means which accordingly can be designated as tension-return gas valve means. During the rinsing procedure according to the teaching of the present invention, the tension-return gas valve means has the object to make free the path for the rinsing means out of the container for rinsing the tension-return gas path.

The special features of the teaching of the present disclosure include the cover means arranged for each filling element with a built-in rinsing valve means as well as the character of the container relief means of the filling element relative to an annular passage that is connected by way of a conduit that can be closed off with which the conduit for supplying rinsing means is connected to the fluid supply container.

The U.S. Pat. No. 3,478,785—Mallrich belonging to the assignee of the present invention shows a counter-pressure filling machine in a multiple chamber manner of the construction. With the teaching of the present invention, the concern in contrast is with a rinsing apparatus for a one-chamber counter-pressure filling system. There are also lacking here the special features of the teaching of the present invention.

With the teaching of the present invention, the filling element is surrounded by a housing of its own and fluid and gas connections are provided by way of special access means relative to the fluid container. The special features of the teaching of the present invention include particularly the cover means of the filling element with built-in rinsing valve means and the connection of the container relief conduit with respect to a common annular passage which is connected by way of a conduit capable of being blocked off with a conduit for rinsing means leading to the fluid container.

Reference can be made to a color prospectus P81039 issued by the assignee of the present invention. The illustrations of the rinsing device upon pages 14 and 15 of the color prospectus coincide as far as possible with the drawing illustrations in the present case. Out of the prospectus illustrations there can be recognized by way of the indicating arrows the fluid paths, and these should be useful for clarification of the situation. There is to be noted, however, that the prospectus illustrations are not quite complete. Upon the container cover there is lacking for instance the blocking-off element 43. Additionally, the connection between the rinsing means conduit 3 and filling material supply conduit 4 is not established as illustrated in FIG. 4 of the present case. The connection between the conduits 3 and 4 is undertaken in a different manner which, however, is not illustrated. With presentation of the prospectus, however, the ancillary questions should be clarified.

The foregoing disclosure includes description as to the filling procedure of the machine even though this actually has nothing to do with the rinsing procedure pertaining to the present invention. In this connection, however, attention is directed thereto that especially the FIGS. 4, 5 and 6 of the drawings pertain only to the rinsing procedure and the particular positioning of the valves. The filling procedure as such cannot be ascertained or recognized in the FIGS. 4, 5 and 6. There can be seen therefrom that in the filler container no fluid chamber, respectively, no fluid level and no gas chamber have been illustrated located above the fluid level.

The U.S. Pat. No. 3,513,024—Culliton issued May 19, 1970 concerns a rinsing device for a simple elevational filler with a filler container open to the atmosphere. The filling material consists of quiet fluids or, in other words, not containing any carbon dioxide in the fluid (not carbonated) and there is flowing with this filler on the basis of the normal drop between the filler container and the bottles located therebelow being filled. Hereby atmospheric pressure prevails both in the filler container and also in the bottles. In contrast hereto, there is noted that the rinsing device of the present invention involves a counter pressure filling machine which serves for filling off of carbonated fluids. On the basis of this filling material there is noted that the filler container is closed off as to the atmosphere and there prevails therein the fluid pressure which corresponds to the gas pressure located above the filling material. With this gas pressure the bottle also becomes preloaded.

The U.S. Pat. No. 3,513,024—Culliton issued May 19, 1970 also has the filling elements just as simple as the filler. The same are collectively provided on the periphery of the filler bottom and have only a fluid valve actuated by way of a bottle being pressed into engagement. A tension- and return gas valve means do not require such elements since only quiet fluids and no carbonated fluids become filled therewith.

In contrast hereto, there is noted that the rinsing device has filling elements therewith fastened laterally on the outer periphery of the filler container and these in addition to fluid valves also have tension- and return gas valve means and relief valve means therewith. The filling elements of the present invention accordingly differ as to the arrangement, construction and manner of operation basically diverging from any features of U.S. Pat. No. 3,513,024—Culliton issued May 19, 1970.

With the U.S. Pat. No. 3,513,024—Culliton issued May 19, 1970 the cleaning extends only as to the fluid valve means and the fluid discharge of the filling element as well as the filler container. In addition to these elements, the present invention also provides for cleaning of the tension-and return gas valve means and the relief valve means.

With the U.S. Pat. No. 3,513,024—Culliton there is noted that the rinsing procedure can occur both for the filler container and also for the exterior of the filling elements only with an additional special container necessary for every filling element in the form of a metal container provided with the guidance of conduits. For this purpose, the container at a time must be pressed accurately against the filling element and must become centered so that the outer pipe conduits are directed exactly toward the fluid valve means and the external cleansing of the valve can occur. In the same manner conditions exist with respect to the inner pipe conduits which must at a time be located accurately with respect to the fluid discharge. In contrast with the present invention, there is not necessary any bottle or the like as a container and even less moreover would there be any container provided with any complex pipe conduits being necessary as with the U.S. patent of Culliton.

The internal cleansing of the filling elements and filler container of Culliton U.S. Pat. No. 3,513,024 would be possible only in connection with external cleansing. In contrast, the teaching of the present invention permits a separate internal cleansing and external cleansing of the filler container and of the filling elements. Thus, distinction is believed to be provided as basis therefor that the teaching of the present invention provides a new and useful rinsing device making possible separate internal cleansing and external cleansing of the filler container and filling elements.

It is, of course, to be understood that the present invention is, by no means, limited to the particular showing in the drawings but also comprises any modifications within the scope of the appended claims.

What we claim is:

1. In combination with a vessel filling machine of the one-chamber type having a plurality of filling elements for individual vessels, a filling container having first conduit means leading from said filling container to each of said filling elements respectively and gas supply means structurally connected to feed a gas to each of said filling elements, second conduit means leading from said filling container to each of said filling elements respectively and liquid supply means structurally connected to said second conduit means to feed a liquid to each of said filling elements, further conduit means connected to said filling container for feeding fluid means thereto, cover means closing the top of each of said filling elements, each of said filling elements respectively being provided with pressure relief conduit means for relieving the individual vessels internally to be filled by the vessel filling machine, annular passage means common to all of said filling elements, third conduit means for respectively establishing communication between said pressure relief conduit means in each of said filling elements and said annular passage means, said machine being constructed for rinse-cleaning in that the top of said filling container is formed with a first outlet and shut-off valve means are associated with said first outlet for controlling the same, said filling container being adapted to be filled with cleaning fluid through said further conduit means connected to said container, each of said cover means having a further outlet means for conveying fluid from the interior of said filling elements to an exhaust, built-in control valve means arranged within said cover means for controlling said further outlet means, so that said cleaning fluid means may pass out through said exhaust when said built-in control valve means is opened, fourth conduit means leading from said annular passage means to said further conduit means, and control valve means arranged in said fourth conduit means for controlling communication between said further conduit means and said annular passage means, and valve actuation cam means for opening said built in control valve means, and a relief valve means in said pressure relief conduit means respectively, whereby said cleaning fluid is adapted to be admitted from said annular passage means to said pressure relief conduit means for flushing said relief conduit means when said relief valve means is opened.

2. A machine in combination according to claim 1, in which said further outlet means comprises a substantially horizontal passage located higher within said cover means.

3. A machine in combination according to claim 2, in which said built-in control valve means controlling said further outlet means is formed by substantially vertically displaceable valve body means protruding outwardly from said cover means and operable from the outside thereof.

4. A machine in combination according to claim 3, in which said cover means within the region of said further outlet means has a chamber communicating with said further outlet means, and in which said cover means also includes connecting conduit means communicating with said first conduit means, said built-in control valve means controlling said further outlet means in a first position to establish communication of said chamber with said connecting conduit means and in a further position to interrupt said last mentioned communication without disassembly.

5. A machine in combination according to claim 4, in which each of said filling elements has a tension and return gas relief valve and a liquid control valve, and in which said valve body means has abutment means operable in said first position of said valve body means to locate said tension and return gas relief valve and said liquid control valve in their closed position.

6. A machine in combination according to claim 5, which includes control cam means movable into the path of said built-in control valve means controlling said further outlet for mechanically actuating the same.

* * * * *

UNITED STATES PATENT OFFICE

CERTIFICATE OF CORRECTION

Patent No. 3,991,797 Dated Nov. 16, 1976

Inventor(s) Gerhard Uth et al.

It is certified that error appears in the above-identified patent and that said Letters Patent are hereby corrected as shown below:

On the Title Page, item [75] inventors: should read -- Gerhard Uth, Bad Kreuznach; Heinrich Zeimet, Bingen-Budesheim; Alfred Rentel, Bad Kreuznach-Winzenheim, all of Germany --.

Signed and Sealed this

Fifteenth Day of February 1977

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,991,797 Dated November 16, 1976

Inventor(s) Gerhard Uth et al.

It is certified that error appears in the above-identified patent and that said Letters Patent are hereby corrected as shown below:

The sheets of drawings containing Figures 1, 2 and 3 should be canceled and the attached sheets of drawings substituted therefor.

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*